US005749807A

United States Patent [19]

Webb

[11] Patent Number: 5,749,807

[45] Date of Patent: May 12, 1998

[54] EXERCISE APPARATUS AND ASSOCIATED METHOD INCLUDING RHEOLOGICAL FLUID BRAKE

[75] Inventor: Gregory M. Webb, Independence, Va.

[73] Assignee: Nautilus Acquisition Corporation, Independence, Va.

[21] Appl. No.: 483,141

[22] Filed: Jun. 7, 1995

Related U.S. Application Data

[60] Division of Ser. No. 221,743, Mar. 31, 1994, abandoned, which is a continuation-in-part of Ser. No. 6,362, Jan. 19, 1993, Pat. No. 5,374,227.

[51] Int. Cl.[6] ..... A63B 22/00; A63B 23/10

[52] U.S. Cl. ..... 482/52; 482/903

[58] Field of Search ..... 482/58, 903, 57, 482/51, 900, 1, 4–9, 52, 54

[56] References Cited

U.S. PATENT DOCUMENTS

| | | | |
|---|---|---|---|
| 3,747,924 | 7/1973 | Champoux | 272/79 |
| 3,858,873 | 1/1975 | Jones | 272/58 |
| 4,278,095 | 7/1981 | Lapeyre | 128/689 |
| 4,298,893 | 11/1981 | Holmes | 358/190 |
| 4,542,897 | 9/1985 | Melton et al. | 272/73 |
| 4,589,656 | 5/1986 | Baldwin | 272/73 |
| 4,659,074 | 4/1987 | Taitel et al. | 272/69 |
| 4,708,338 | 11/1987 | Potts | 272/20 |
| 4,720,093 | 1/1988 | Del Mar | 272/70 |
| 4,775,145 | 10/1988 | Tsuyama | 272/73 |
| 4,786,049 | 11/1988 | Lautenschlager | 272/73 |
| 4,790,528 | 12/1988 | Nakao et al. | 272/73 |
| 4,805,901 | 2/1989 | Kulick | 272/73 |
| 4,817,938 | 4/1989 | Nakao et al. | 272/73 |
| 4,920,929 | 5/1990 | Bishop | 123/41.49 |
| 4,923,057 | 5/1990 | Carlson et al. | 188/378 |
| 4,992,190 | 2/1991 | Shtarkman | 252/62.52 |
| 5,013,031 | 5/1991 | Bull | 272/70 |
| 5,015,926 | 5/1991 | Casler | 318/9 |
| 5,031,900 | 7/1991 | Lesk | 272/73 |
| 5,033,733 | 7/1991 | Findlay | 272/70 |
| 5,075,023 | 12/1991 | Fukuyama et al. | 252/74 |
| 5,087,382 | 2/1992 | Ishino et al. | 252/73 |
| 5,139,691 | 8/1992 | Bloink et al. | 252/74 |
| 5,167,850 | 12/1992 | Shtarkman | 252/62.52 |
| 5,248,113 | 9/1993 | Daniels | 242/246 |
| 5,257,681 | 11/1993 | Shtarkman et al. | 188/267 |
| 5,269,556 | 12/1993 | Heyring | 280/6.12 |
| 5,276,623 | 1/1994 | Wolfe | 364/424.05 |
| 5,277,281 | 1/1994 | Carlson et al. | 188/267 |
| 5,284,330 | 2/1994 | Carlson et al. | 267/140.14 |
| 5,409,435 | 4/1995 | Daniels | 482/58 |

FOREIGN PATENT DOCUMENTS 2 114 901 9/1983 United Kingdom .

OTHER PUBLICATIONS

Active Damping Using ERM Fluids, Automotive Engineering pp. 19–23, Jun. 1993.

*Primary Examiner*—Stephen R. Crow

*Attorney, Agent, or Firm*—Bell Seltzer Intellectual Property Law Group of Alston & Bird, LLP

[57] ABSTRACT

An exercise apparatus includes a frame, user actuation components connected to the frame for being engaged and moved by a user during an exercise, and a rheological fluid brake operatively connected to the user actuation components for applying a controllable resistance to movement thereof. The rheological fluid brake includes a rheological fluid having a controllable viscosity, a housing connected to the frame and containing the rheological fluid, and a rotatable shaft extending outwardly from the housing and connected between the rheological fluid and the user actuation components. A flywheel is also preferably connected to the rotatable shaft to further smooth action of the brake. A controller, such as a microprocessor operating under stored program control, is preferably operatively connected to the rheological fluid brake for causing a predetermined field strength to be applied to the rheological fluid based upon a user-selected resistance value. In one embodiment, the rheological fluid is a magnetorheological fluid and in another embodiment, the fluid is a electrorheological fluid. A stair stepper, exercise bicycle and treadmill incorporating the rheological brake are disclosed.

12 Claims, 8 Drawing Sheets

30
12
10
13
11
47
56
49
44
16
23
20
15
57
53
21
41
24
39
22
40
25
42
43
51
21
24
16
23
50
55
45
43
41
20
14
46
40
22
42

EXERCISE APPARATUS AND ASSOCIATED METHOD INCLUDING RHEOLOGICAL FLUID BRAKE

RELATED APPLICATION

This is a divisional of application Ser. No. 08/221,743, filed 31 Mar. 1994, now abandoned, which is a continuation-in-part application of application Ser. No. 08/006,362 filed Jan. 19, 1993, now U.S. Pat. No. 5,374,277.

FIELD OF THE INVENTION

The invention relates to the field of exercise equipment, and more particularly, to an exercise apparatus having a controllable resistance.

BACKGROUND OF THE INVENTION

Exercise equipment is widely used by individuals at home and in a spa setting to obtain both strength and aerobic exercise. From free weights, strength training has now progressed to typically include the use of one or more exercise machines for greater ease of use and safety. For example, U.S. Pat. No. 3,858,873 to Jones, and assigned to the assignee of the present invention, discloses cams to provide nonlinear resistance compatible with that developed by human joints and muscles.

Aerobic classes have enjoyed widespread popularity for aerobic training of the cardiovascular system. In addition, aerobic exercise machines have been developed, such as, for example, stationary bicycles, rowing machines, treadmills, cross-country ski trainers, and stair stepping machines. Stair stepping machines, for example, are particularly popular for toning the muscles of the lower body and providing an excellent aerobic workout. A typical stair stepper includes two foot platforms which the user alternately depresses by shifting his body weight and straightening the respective legs to thereby perform the simulated stair climbing exercise. The foot platforms are typically connected to a load to provide resistance to the user's stepping motion. For example, U.S. Pat. No. 3,747,924 to Champoux discloses a stair stepper with interconnected foot platforms so that the load on one foot platform is provided by the user's weight carried by the other foot platform. U.S. Pat. No. 4,708,338 to Potts discloses a stair stepper with an electrical alternator and resistor to provide the load for the user. U.S. Pat. No. 4,720,093 to Del Mar discloses a stair stepper having a flywheel and friction band to provide resistance. U.S. Pat. No. 5,033,733 to Findlay discloses a stair stepper with an electromagnetic brake to provide the resistance for the user's movement.

An exercise or stationary bicycle with an alternator serving as a controller resistance supplying means is disclosed, for example, in U.S. Pat. Nos. 4,542,897 to Melton et al.; 4,298,893 to Holmes; and 4,805,901 to Kulick. Other types of resistance supplying means have also been used including friction generated by rotation of a wheel against a fixed band or belt. In addition, U.S. Pat. Nos. 4,790,528 to Nakao et al.; 4,786,049 to Lautenschlager; 5,031,900 to Leask; and 4,775,145 to Tsuyama each disclose an exercise bicycle having an eddy current brake to provide controllable resistance during the exercise.

U.S. Pat. No. 4,589,656 to Baldwin discloses an exercise bicycle using a fan arrangement to provide the resistive load for the user. The Baldwin patent also discloses the seat bottom being lower than the axis of the pedal crank to position the user's feet to be at or above the level of the user's hips to thereby provide circulation benefits and increase freedom of movement of the user's knees and thighs.

Another example of an aerobic exercise apparatus is a passive treadmill. A passive treadmill typically includes an endless belt arranged around a pair of spaced apart rollers, as shown, for example in U.S. Pat. No. 4,659,074 to Taitel et al. The treadmill includes controllable friction brake pads to provide a load or resistance for the user.

A resistance supplying means, such as an eddy current brake, friction brake, electromagnetic brake, alternator, or fan is desirably readily controllable, as well as smooth in operation. Moreover, considerable noise may be generated by such conventional load resistance supplying means. This noise may reduce the enjoyment of the exercise and/or increase monotony associated with the exercise.

For stair steppers, bicycles, treadmills and other stationary exercise machines, for example, it may also be desirable to provide the user with feedback concerning the level of effort and performance. For example, U.S. Pat. No. 4,708,338 to Potts discloses a display of vertically oriented lights indicative of the varying level of resistance versus time for the exercise period. While such a visual display provides some feedback to the user, it does little to relieve any boredom that may result during an extended exercise period.

SUMMARY OF THE INVENTION

In view of the foregoing background, it is therefore an object of the present invention to provide an exercise apparatus and associated method that produces smooth and readily controlled resistance during the exercise.

It is another object of the invention to provide an exercise apparatus and associated method that is relatively quiet in operation.

It is yet another object of the invention to provide an exercise apparatus including a display of information relating to performance of the exercise, as well as entertainment, to relieve any boredom during extended exercise periods.

These and other objects, features and advantages according to the present invention are provided by an exercise apparatus including a frame, user actuation means connected to the frame for being engaged and moved by a user during exercise, and rheological fluid resistance means or a rheological fluid brake operatively connected to the user actuation means for applying a controllable resistance to movement thereof. The rheological fluid resistance means preferably includes a rheological fluid having a controllable viscosity, a housing connected to the apparatus frame and which contains the rheological fluid, and a rotatable shaft extending outwardly from the housing and operatively connected between the rheological fluid and the user actuation means. A flywheel is also preferably connected to the shaft to further smooth action of the brake.

The rheological fluid resistance means provides efficient, reliable and readily controllable resistance to performance of the exercise. In addition, the resistance is smooth and the rheological brake is relatively quiet as compared to conventional fans, alternators, or friction brakes, for example.

Control means, such as a microprocessor operating under stored program control, is preferably operatively connected to the rheological fluid resistance means for causing a predetermined field strength to be applied to the rheological fluid based upon a user-selected resistance value. Accordingly, a desired resistance to movement of the user actuation means may be readily provided and also varied during performance of the exercise. In one embodiment of the invention, the rheological fluid is a magnetorheological fluid having a controllable viscosity responsive to an applied magnetic field. Thus, the rheological resistance means is a magnetorheological brake preferably including an electromagnet adjacent the magnetorheological fluid and powered by the control means for applying a magnetic field of predetermined strength to the fluid.

In another embodiment of the invention, the rheological fluid is an electrorheological fluid having a controllable viscosity responsive to an applied electric field. Accordingly, the electrorheological brake preferably includes a pair of spaced apart conductive plates adjacent the fluid for establishing, responsive to the control means, an electric field of predetermined strength in the electrorheological fluid.

One embodiment of the exercise apparatus may preferably be a stair stepper. Accordingly, the user actuation means comprises left and right foot platforms connected to the frame for movement between up and down positions as each foot platform is alternately depressed by the user. For the stair stepper, the user actuation means also includes unequal-length four-bar linkage means for connecting each foot platform to the frame as described in U.S. Pat. application Ser. No. 08/006,362 filed Jan. 19, 1993, and assigned to the assignee of the present invention, the entire disclosure of which is hereby incorporated herein by reference.

Another embodiment of the exercise apparatus is preferably an exercise bicycle. Accordingly, the exercise bicycle includes a pair of foot pedals, and crank means for rotatably connecting the foot pedals to the frame. The rheological resistance means as described above provides the resistance to the user's bicycle pedalling motion. In addition, the seat base is preferably connected to the frame to be positioned lower than the axis of rotation of the foot pedals to thereby seat the user in a recumbent position.

In yet another embodiment of the exercise apparatus according to the invention, the user actuation means comprises an endless belt and a pair of spaced apart rollers around which the endless belt is positioned to thereby define a passive treadmill. The rollers permit the endless belt to rotate as a user strides thereon while the controllable resistance is provided by the rheological fluid resistance means.

The exercise apparatus preferably further comprises a display carried by the frame and operatively connected to the control means. The control means also preferably includes means for permitting the input of and displaying the user-selected resistance value. In addition, a sensor is preferably associated with the rheological fluid resistance means and is connected to the control means for generating and displaying on the display a work level of a user during an exercise. An integral television tuner is preferably included with the display to permit viewing of broadcast or cable television programs during the exercise session, such as to reduce boredom during the exercise session.

A method aspect according to the present invention is for providing a user selected resistance during exercise on an exercise apparatus of a type including a frame and user actuation means connected to the frame for being engaged and moved by a user during exercise. The method preferably includes the steps of: coupling a rheological fluid brake to the user actuation means, the rheological fluid brake comprising a rheological fluid having a controllable viscosity; and applying a predetermined field strength to the rheological fluid based upon a user selected resistance value to thereby provide the desired resistance.

As described above, in one embodiment, the rheological fluid is a magnetorheological fluid having a controllable viscosity responsive to an applied magnetic field. Accordingly, the step of applying a predetermined field strength comprises applying a magnetic field of predetermined strength to the magnetorheological fluid. In another embodiment, the rheological fluid is a electrorheological fluid having a controllable viscosity responsive to an applied electric field, and wherein the step of applying a predetermined field strength includes applying an electric field of predetermined strength to the electrorheological fluid.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Applicants provide these embodiments so that this disclosure will be thorough and complete, and will fully convey the scope of the invention to those skilled in the art. Prime notation is used to indicate like elements in alternate embodiments.

Figure 1:
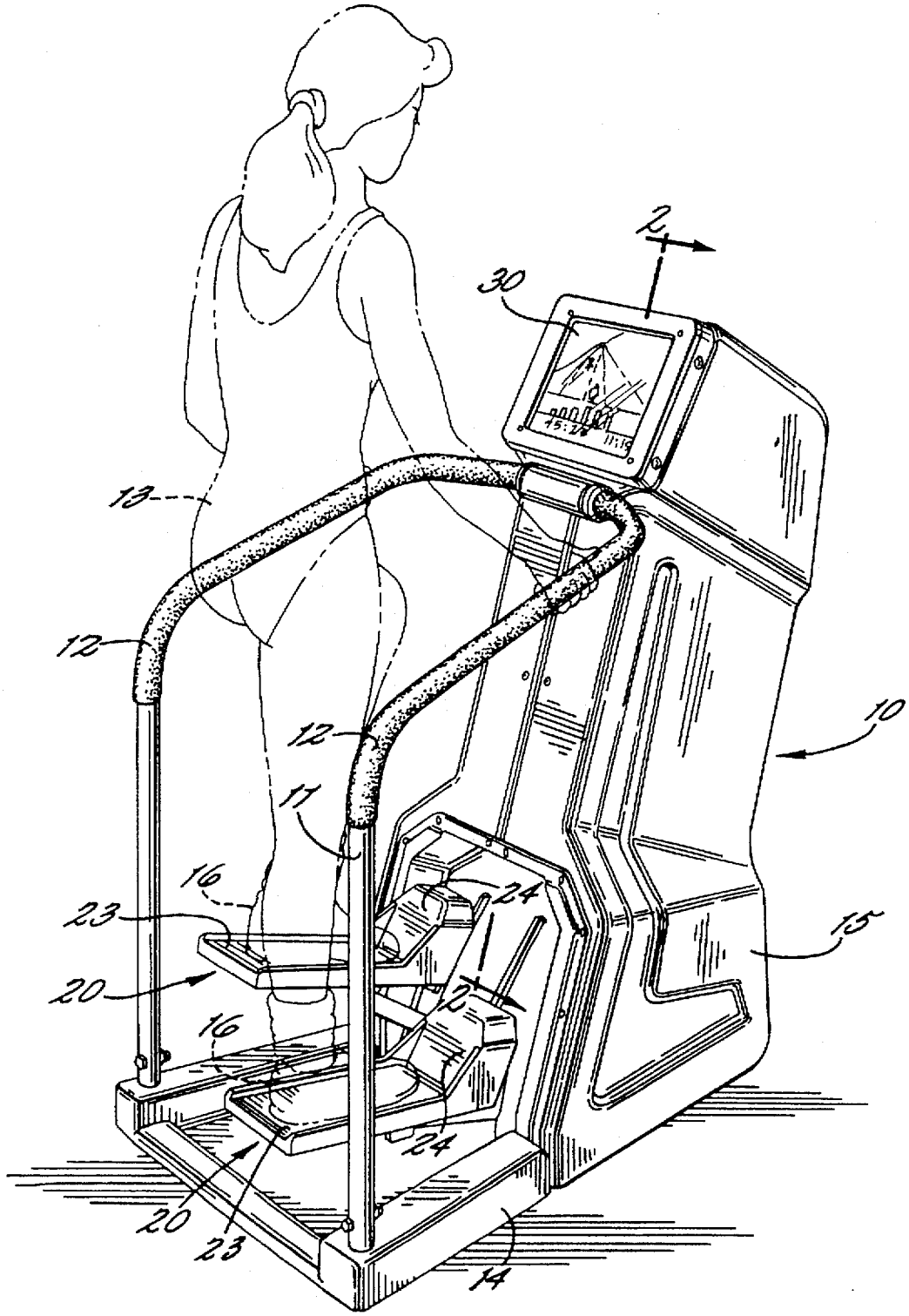
FIG. 1 is a perspective view of the stair stepper exercise apparatus according to the invention.
Figure 2:
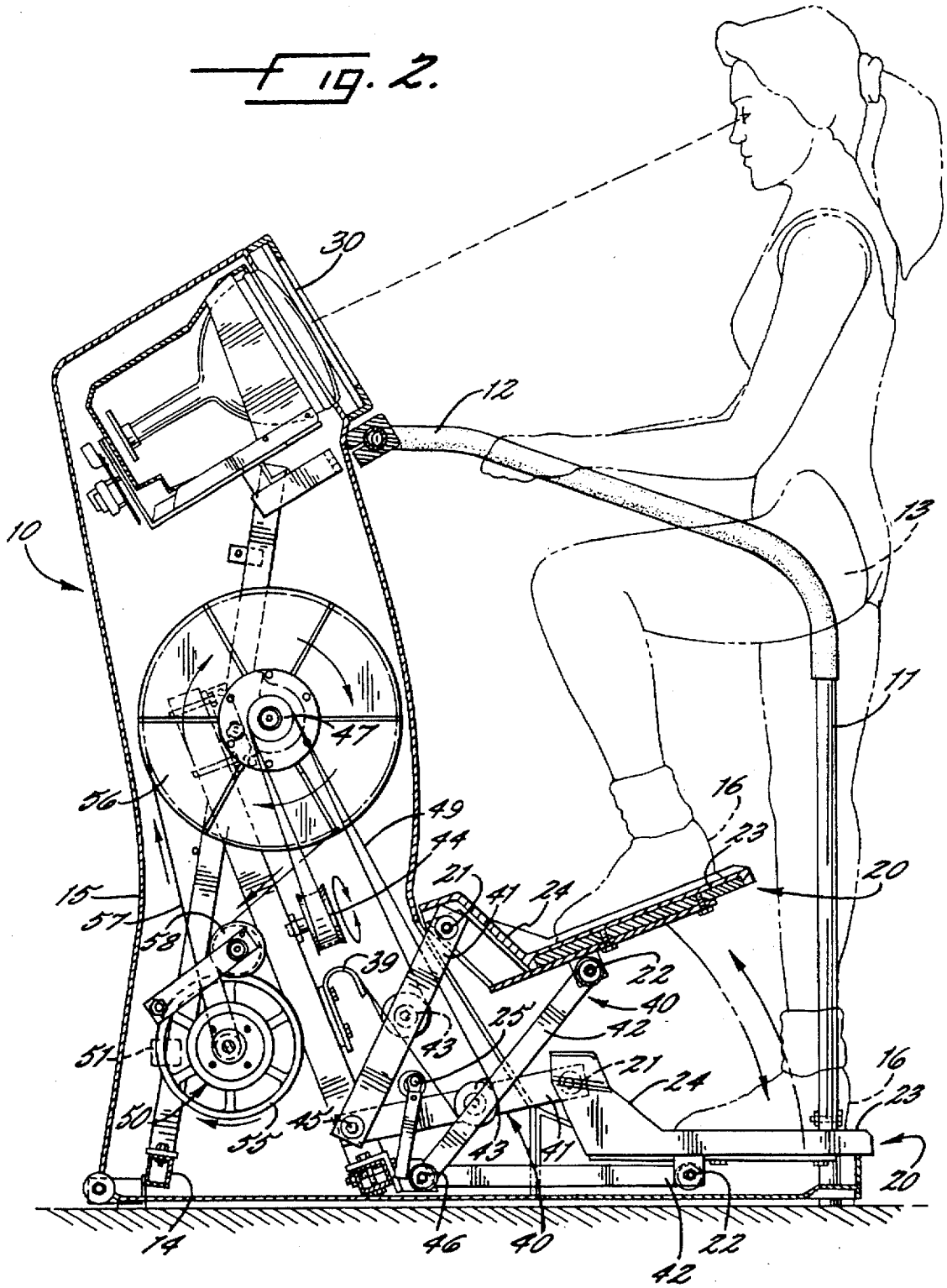
FIG. 2 is a side elevational view of the stair stepper exercise apparatus taken along lines 2—2 in FIG. 1.

The stair stepper of the present invention is generally designated as 10 in the accompanying drawings. Referring first to FIGS. 1 and 2, the stair stepper 10 includes a frame 14 supporting a pair of hand rails 11, which in turn are fitted with hand grips 12 for grasping by the user 13 to assist the user in maintaining balance while performing the simulated stair climbing exercise. A housing 15 is mounted on the frame 14 to enclose a display 30 and other components as more fully described below. As illustrated, the display 30 is mounted to the top of the frame 14 and is positioned so that it can be viewed by the user 13 while exercising.

Left and right foot platforms 20 support the respective feet 16 of the user 13 while exercising. Each foot platform 20 has a base portion 23 and a toe portion 24 extending outwardly therefrom to ensure that the feet 16 of the user 13 are properly positioned during the exercise and are fully supported when the foot platforms 20 are in the raised position.

As best understood by reference to FIG. 2, each foot platform 20 is pivotally connected to the frame 14 by an unequal-length four-bar linkage 40 that provides the linkage means for connecting each foot platform to the frame. Each four-bar linkage 40 includes an upper connecting bar 41 and a lower connecting bar 42. The upper connecting bar 41 is pivotally connected to the foot platform 20 by an upper foot platform pivot pin 21 and to the frame 14 by an upper frame pivot pin 45. The lower connecting bar 42 is pivotally connected to the foot platform 20 by a lower foot platform pivot pin 22 and to the frame 14 by a lower frame pivot pin 46. The upper connecting bar 41 and the lower connecting bar 42 are unequal in length as are the distances between the upper frame pivot pin 45 and lower frame pivot pin 46, and upper foot platform pivot pin 21 and lower foot platform pivot pin 22, thus defining the unequal-length four-bar linkage 40.

Figures 6A, 6B, 6C:
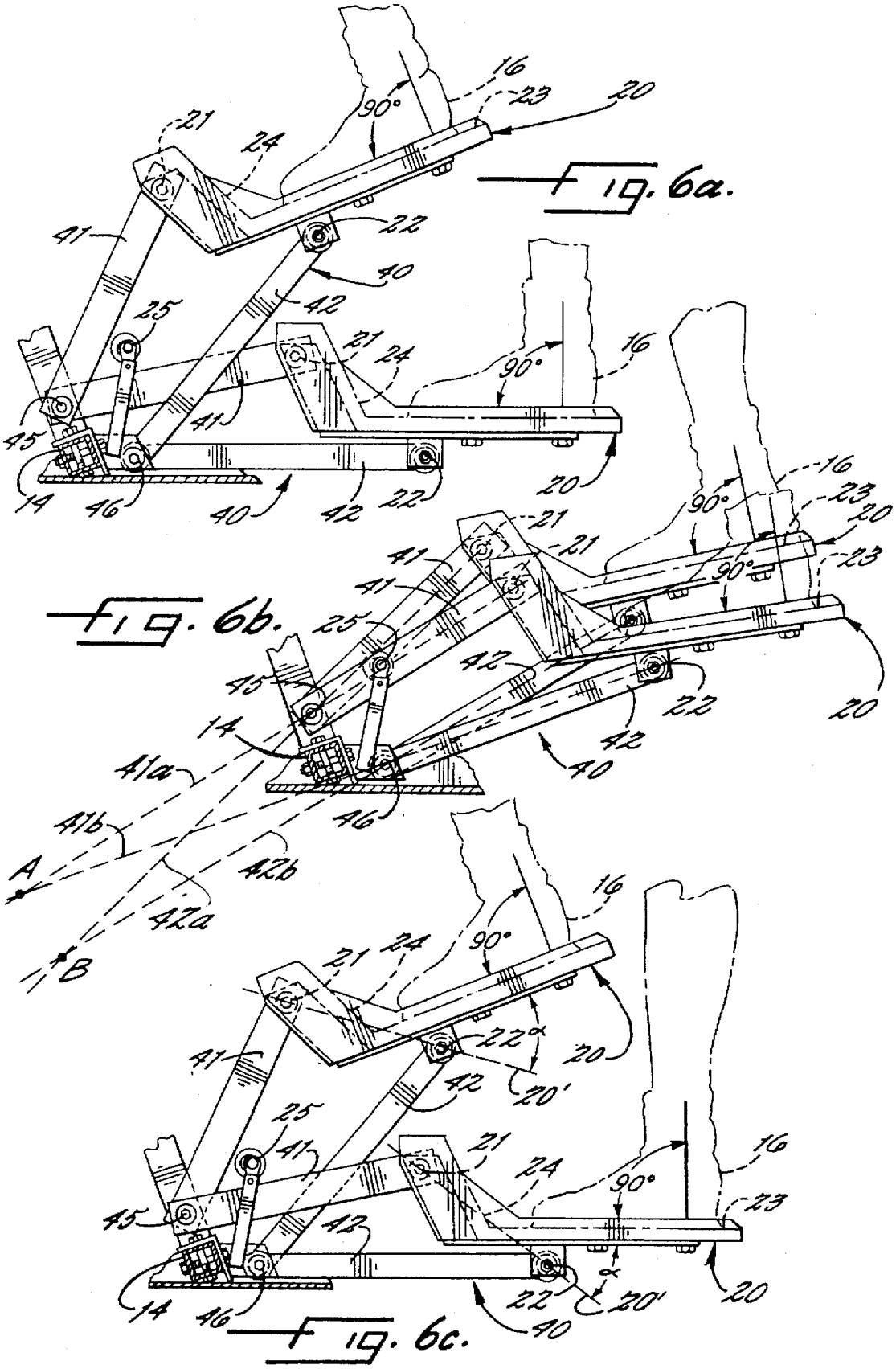
FIGS. 6*a*–6*c* are enlarged side elevational views of the foot platforms and unequal-length four-bar linkages of the stair stepper exercise apparatus of the invention at different positions during operation by the user.

As shown in FIGS. 6*a*–6*c*, the unequal-length four-bar linkages 40 connect each foot platform 20 to the frame 14 for permitting alternating up and down movement of each foot platform as each foot platform is alternately depressed by the user 13. The four-bar linkages 40 also serve to maintain each foot platform 20 oriented generally perpendicular to the user's lower leg during the downward movement of each foot platform to thereby reduce undesirable stress on the user's lower leg joints, particularly to reduce undesirable shear forces on the knee joint. The unequal-length four-bar linkages 40 pivotally connect respective left and right foot platforms 20 to the frame 14 so that each platform moves in an arcuate path of travel between a generally horizontal lower position and a raised position wherein each platform is inclined at an angle in the range of about 20° to 25° from the horizontal. More preferably this angle is about 22°. Thus, the unequal-length four-bar linkages 40 maintain the lower legs of the user oriented generally perpendicular to the foot platforms 20 during the alternating up and down full arcuate path of travel of the foot platforms.

Referring more particularly to FIGS. 6*b* and 6*c*, the operation of the linkage means, such as the unequal-length four-bar linkage, is further explained. The linkage means defines a moving axis of rotation or moving instantaneous center for each foot platform 20 indicated by points A, B as defined by intersecting imaginary lines 41A, 42A and 41B, 42B, respectively. Moreover, as shown in FIG. 6c the relationship between each foot platform 20 and the linkage mens is further illustrated by the imaginary line 20' intersecting the pivot points 21, 22 at the horizontal and raised positions, and wherein a constant angle $\alpha$is maintained between the imaginary line 20' and the foot platform 20. Accordingly, each foot platform 20 follows a predetermined path defined by the changing axis of rotation so as to maintain the foot platform 20 oriented generally perpendicular to the user's lower leg during movement of the foot platform.

Figure 3:
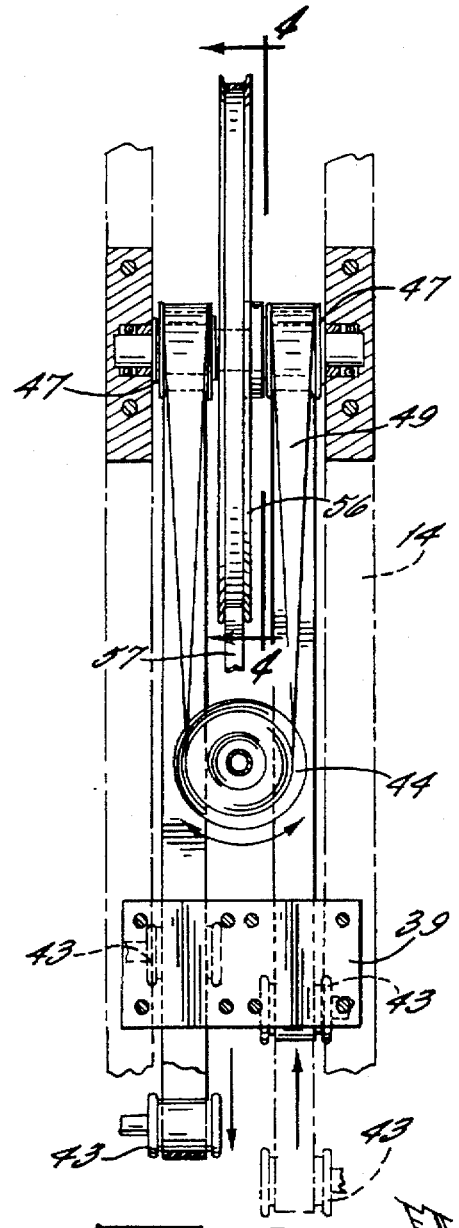
FIG. 3 is a greatly enlarged front elevational view of the belt and pulley dependent coupling means of the stair stepper according to the invention.
Figure 4:
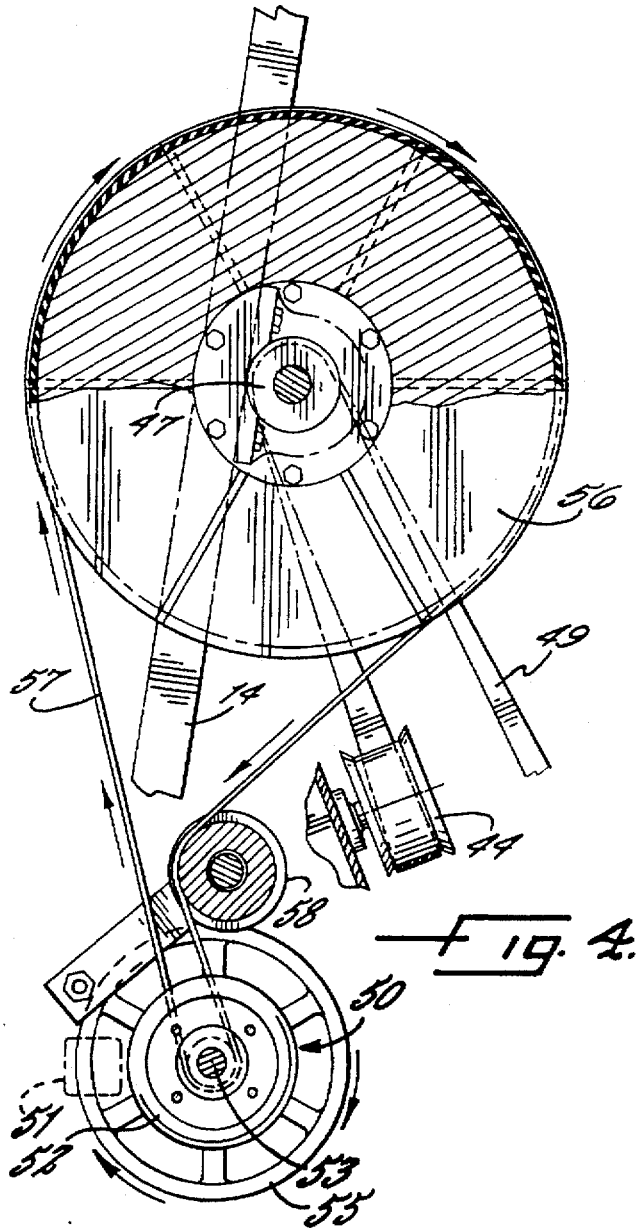
FIG. 4 is a greatly enlarged side elevational view, partially in section, of the rheological fluid brake and drive wheel in the stair stepper exercise apparatus according to the invention.
Figure 5:
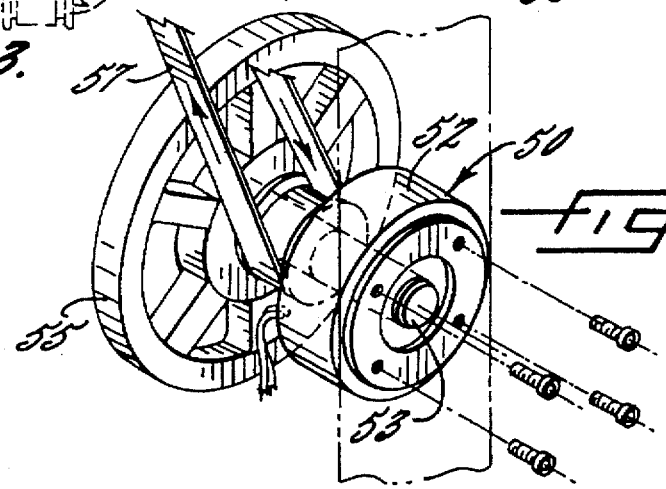
FIG. 5 is a greatly enlarged side elevational view of a portion of the rheological fluid brake and flywheel as shown in FIG. 4.

Referring now additionally to FIGS. 3 and 4, the stair stepper 10 includes a flexible toothed coupling belt 49 dependently coupling the four-bar linkages 40 together as illustrated. The ends of the coupling belt 49 are secured to the frame 14 by a coupling belt anchor 39. The end portions of the coupling belt 49 are directed over pulleys 43 mounted to the upper connecting bar 41 of respective four-bar linkages 40. From the pulleys 43, the coupling belt 49 is directed over drive wheel pulleys 47 and is turned 90° so that the center portion of the belt reciprocates over a central pulley 44.

Each drive wheel pulley 47 is connected to the drive wheel 56 by a one-way clutch, which allows the pulley 47 to freewheel in an unclutched rotational direction and engage in the opposite direction. For example, when the left foot platform 20 is depressed by the user 13, the right-hand drive pulley 47 freewheels and the left-hand pulley 47 engages and rotates the drive wheel 56 in the clockwise direction when viewed from the left hand side of the apparatus 10.

The drive wheel 56 is coupled to a rheological fluid brake or rheological fluid resistance means 50 that provides the desired resistance for the user actuation means, which in this embodiment includes the left and right foot platforms 20 and the unequallength four-bar linkages 40. More particularly, the rheological fluid brake 50 includes a rheological fluid having a controllable viscosity, a housing 52 connected to the frame 14 and containing the rheological fluid, and a rotatable shaft 53 extending outwardly from the housing and operatively connected between the rheological fluid and the drive wheel 56.

The rheological fluid may be a magnetorheological fluid having a controllable viscosity responsive to an applied magnetic field. Accordingly, control means such as an electromagnet may be incorporated into the housing for generating and applying a magnetic field of predetermined strength to the magnetorheological fluid responsive to control means as described in greater detail below. Alternately, the rheological fluid may be an electrorheological fluid having a controllable viscosity responsive to an applied electric field. Accordingly, a pair of spaced apart electrodes may be included within the housing for generating and applying an electric field of predetermined strength to the electrorheological fluid. A user-selected resistance value may be input via the display 30 and control means to thereby provide a desired resistance to movement of the foot platforms 20.

The rheological fluid brake 50 may preferably a magnetorheological brake such as of the type manufactured by the Lord Corporation of Cary, N.C. under model designation MRB-2101. The magnetorheological brake may require a relatively low operating voltage to effect control of the magnetorheological fluid over a useful operating range, while conventional electrorheological fluids may require relatively larger voltages to generate a sufficiently strong electric field.

Magnetorheological fluids are generally known as disclosed in U.S. Pat. Nos. 5,257,681; 5,284,330; 5,277,281; 5,167,850; 4,992,190, the entire disclosures of which are incorporated herein in their entirety by reference. Electrorheological fluids are also generally known as disclosed in U.S. Pat. Nos. 4,923,057; 5,087,382; 5,075,023; and 5,139,691, for example, the entire disclosure of each of these patents being incorporated herein in their entirety by reference.

As shown in the illustrated embodiment, a flywheel 55 is preferably operatively connected to the rotatable shaft 53 of the rheological fluid brake 50 to further smooth out the action thereof. The flywheel preferably has a diameter of about 5 to 10 inches and weighs between 5 to 25 pounds. A drive belt 57 couples the drive wheel 56 and the rheological fluid brake 50 and is tensioned by an idler pulley 58. The ratio of the diameter of the relatively large drive wheel 56 to the relatively small shaft 53 of the rheological fluid brake 50 causes high rotational speed for the brake. In other words, the shaft 53 has a relatively small diameter and is desirably coupled to the drive wheel 56 so that the shaft spins at a relatively high rotational speed to further smooth out the action of the brake. The rheological fluid brake 50, in addition to providing smooth and readily controlled resistance, is also extremely quiet in operation, unlike many conventional brakes or resistance loads.

A rheological brake speed sensor 51 is mounted on the frame 14 to sense rotation of the flywheel 55 in the illustrated embodiment. The sensor provides a signal proportional to the rotational speed of the rheological fluid brake 50.

Figure 7:
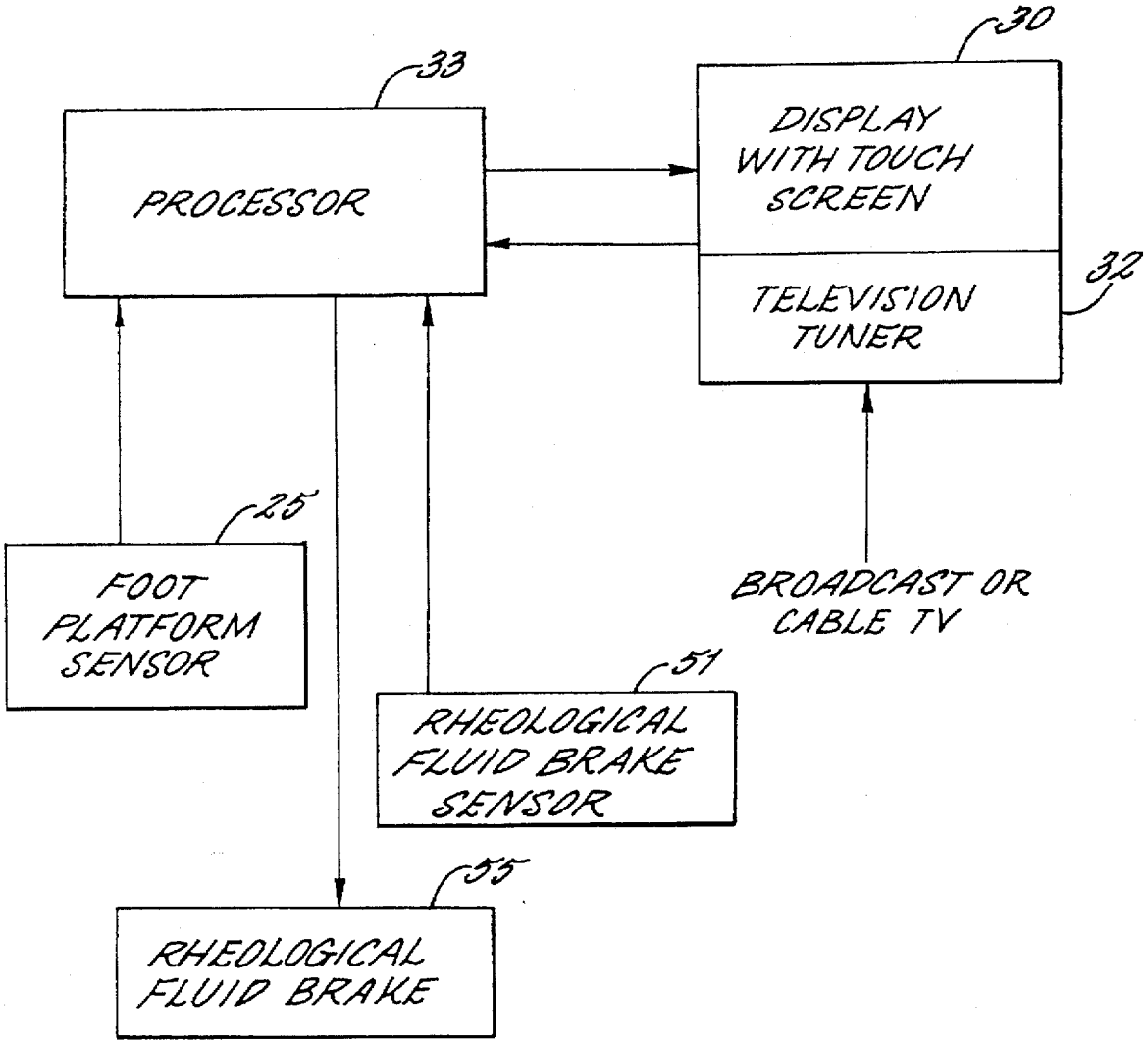
FIG. 7 is a schematic block diagram of the processor and associated components of the stair stepper exercise apparatus of the invention.

Referring now to FIG. 7, the control means or processor 33, display 30 and other associated components are explained. The processor 33 is operatively connected to the foot platform sensor 25 and the rheological brake speed sensor 51 so that the processor can determine the stepping rate of the user 13 and the rotation rate of the brake 50. This and other information may then be displayed on the display 30. The display 30 preferably includes a touch sensitive screen for accepting one or more user inputs. The work level, the stepping rate, and/or a simulated value of the vertical ascent of the user 13 may thus be readily calculated by the processor 33 and displayed on the display 30. As would be readily understood by those skilled in the art, the simulated vertical ascent of the user may be based upon the user's weight, entered as a user input via the touch sensitive screen of the display, and the work level of the user based upon the rheological brake speed sensor 51.

The processor 33, cooperating with the touch sensitive screen, permits the user to select the amount of resistance to be provided by the rheological fluid brake 50, for example, by changing the strength of a magnetic field applied to a magnetorheological fluid, or by changing the strength of an electrical field applied to an electrorheological fluid. The processor 33 may also include memory means for storing preprogrammed exercise routines which vary the resistance versus time as would be readily understood by those skilled in the art.

The display 30 preferably includes an integral television tuner 32 which allows the user 13 to view commercial television programs from commercial broadcast sources or via a cable television connection. The user 13 can also control the television tuner 32 via the touch sensitive screen and may select between a television program or a simulated exercise image.

Figure 8:
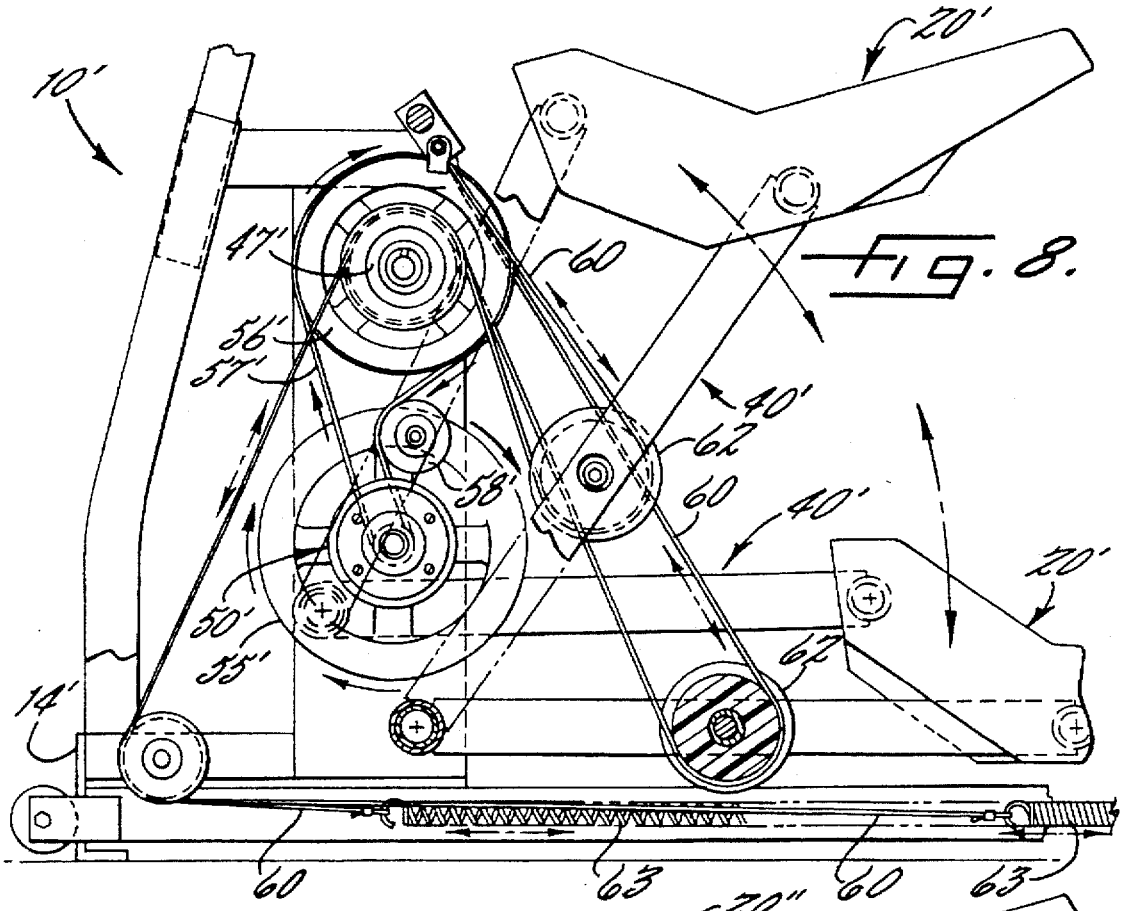
FIG. 8 is a side elevational view of a portion of another embodiment of a stair stepper exercise apparatus according to the invention and having independently movable foot platforms.

Referring now to FIG. 8, a second embodiment of the stair stepper 10' according to the invention is explained. The stair stepper 10' includes the foot platforms 20' and unequal-length four-bar linkages 40' as discussed extensively above. This embodiment of the stair stepper 10', however, includes independent coupling means provided by respective cables 60, pulleys 62, and return springs 63 as illustrated. More particularly, each cable 60 causes rotation of the pulley 47' which freewheels in one rotational direction. One end of each spring is anchored to the frame 14 so that each spring provides a bias to cause each foot platform 20' to return to the raised or up position when the user lifts their leg.

The rheological fluid brake 50' and other components of the embodiment of the stair stepper 10' illustrated in FIG. 8 indicated with prime notation are similar to corresponding elements described with reference to FIGS. 1–7, and, hence, require no further description to those of skill in the art.

Figure 9:
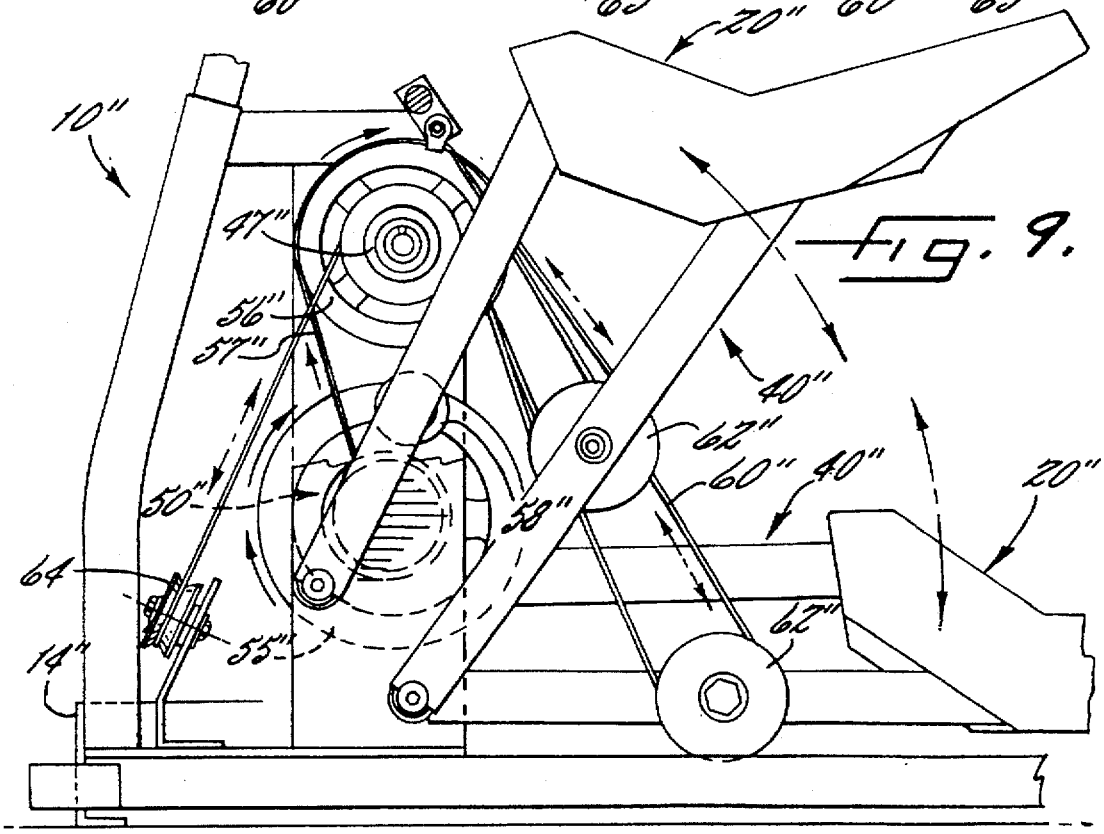
FIG. 9 is a side elevational view of a portion of yet another embodiment of a stair stepper exercise apparatus according to the invention and having dependently movable foot platforms.

Referring now to FIG. 9, a third embodiment of a stair stepper 10" according to the invention is described. This embodiment is similar in configuration to each of the two preceding stair stepper embodiments. The stair stepper 10" includes the rheological fluid brake 50", unequal-length four-bar linkages 40", and foot platforms 20" as described above. This third embodiment, however, includes dependent coupling means similar to that shown with respect to the first embodiment of FIGS. 1–7. This third embodiment also includes pulleys 62", cables 60", unequal-length four-bar linkages 40", and foot platforms 20" to permit up and down movement of the foot platforms. A pulley 64 adjacent the front of the frame 14" provides a crossover point for the cable 60" to thereby provide dependent coupling between the two foot platforms 20". A rheological fluid brake 50" also provides the resistance means to provide a controllable load during the exercise. The other components of this third embodiment of a stair stepper 10" are similar to those described above and indicated in FIG. 9 with double prime notation.

Figure 10:
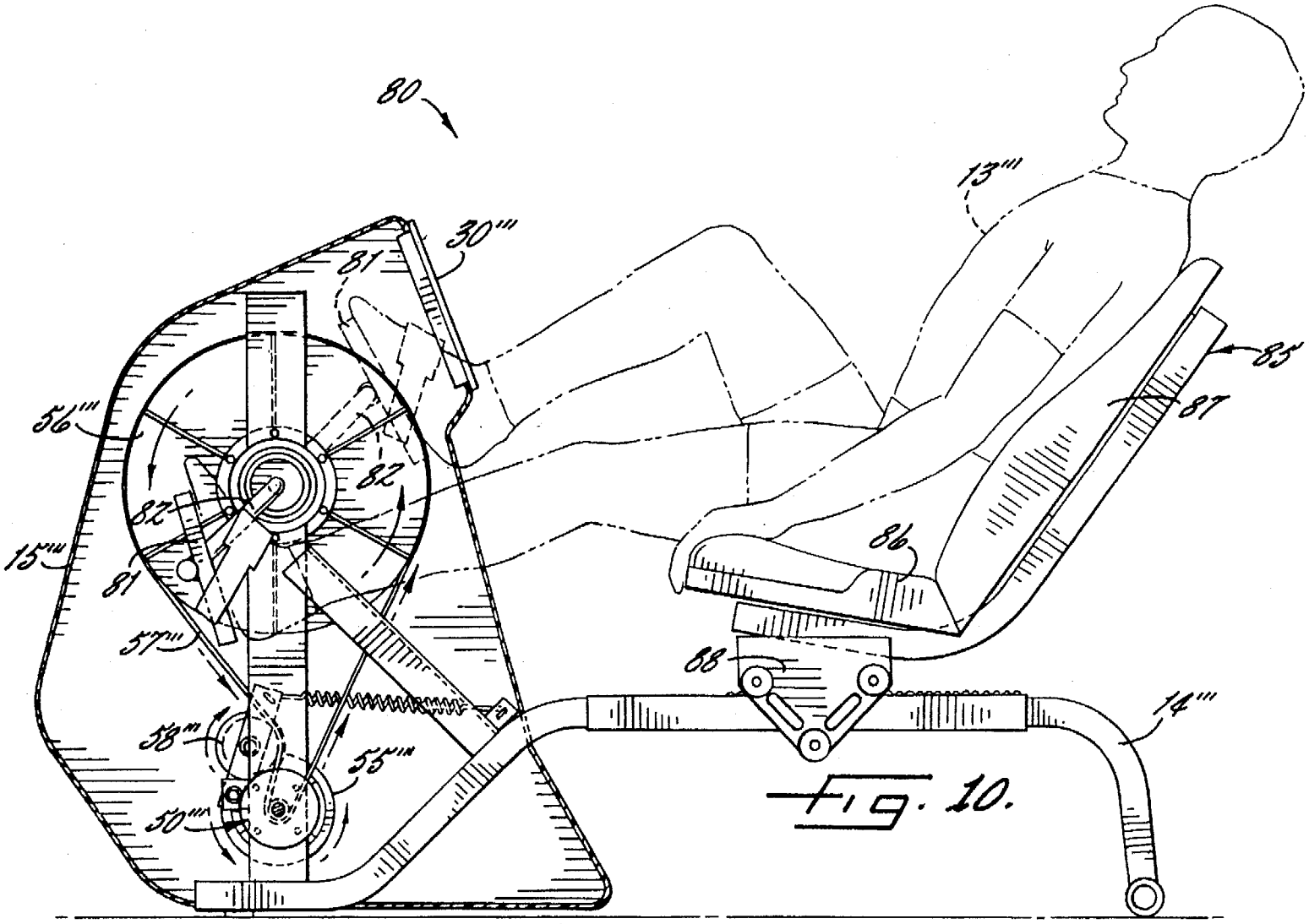
FIG. 10 is a side elevational view, partially in section, of an exercise bicycle according to the invention.

FIG. 10 illustrates an exercise or stationary bicycle 80 according to the invention. The bicycle 80 includes the rheological fluid brake 50''' as described above. Accordingly, the resistance is readily controllable based upon user inputs from the display 30''', and the bicycle is also quiet in operation.

The exercise bicycle 80 includes a pair of foot pedals 81, and crank means provided by a pair of offset crank arms 82 for rotatably connecting the foot pedals to the frame 14'''. The crank arms 82 define an axis of rotation of the foot pedals.

The bicycle 80 further includes a seat 85 having a seat base 86 and mounting means 88 connecting the seat base to the frame. An inclined seat back 87 further supports the back of the user in a comfortable position. The seat base 86 is positioned lower than the axis of rotation of the foot pedals to thereby seat a user 13''' in a recumbent position. In other words, the seat base 86 is lower than the axis of the pedal crank to position the user's feet to be at or above the level of the user's hips to thereby provide circulation benefits and increase freedom of movement of the user's knees and thighs. Other components of the bicycle 80, similar to those described above, are indicated by triple prime notation.

Figure 11:
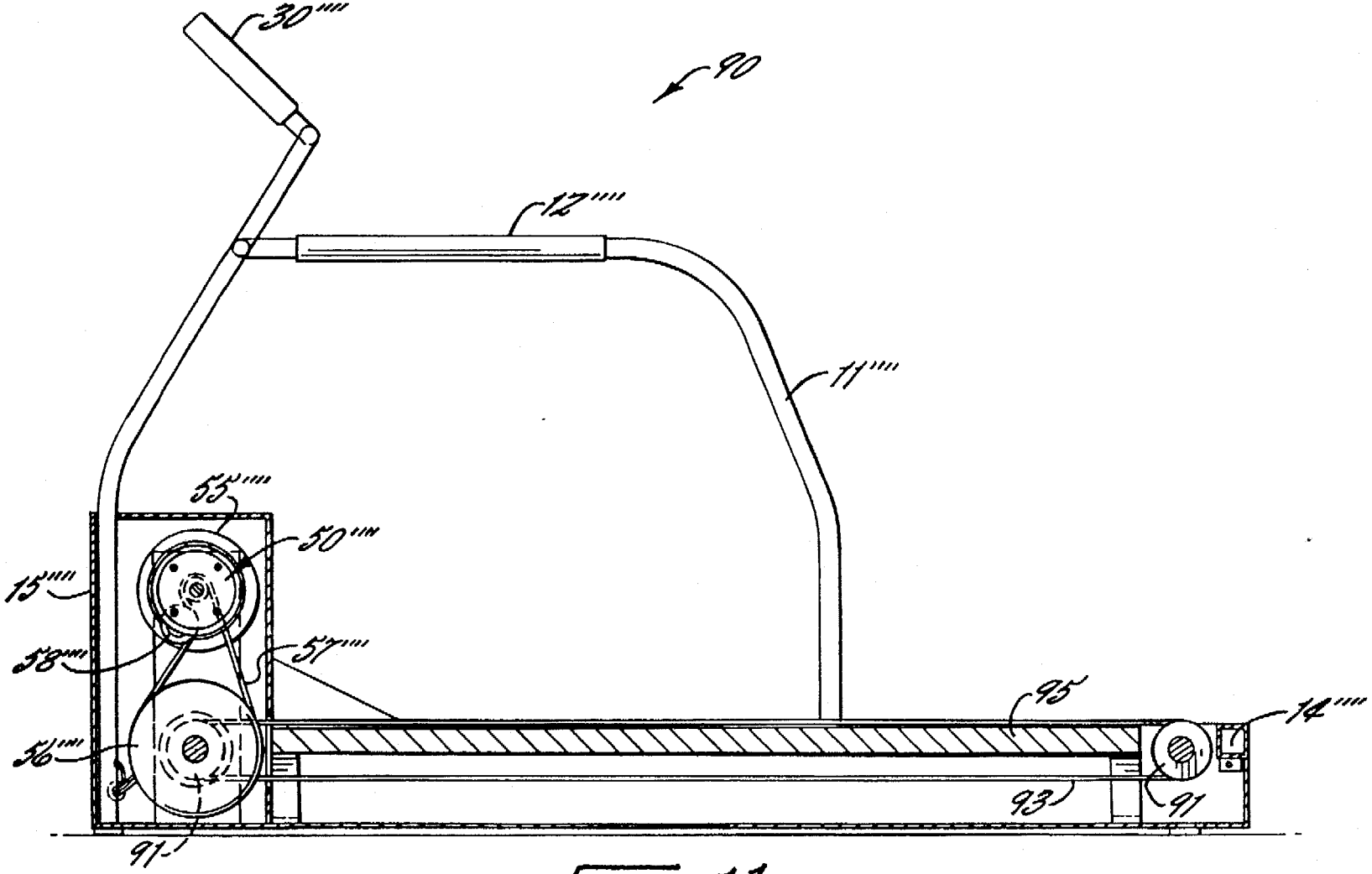
FIG. 11 is a side elevational view, partially in section, of an exercise treadmill according to the invention.

Referring now to FIG. 11, a passive treadmill exercise apparatus 90 according to the present invention is now described. The passive treadmill 90 includes a rheological fluid brake 50 as described above. The treadmill also includes a pair of spaced apart cylindrical rollers 91 supported on a frame 14'''', and an endless belt 93 positioned around the rollers. The endless belt may be of the conventional type and is illustratively supported on a low friction deck 95. As would be readily understood by those skilled in the art, the endless belt 93 rotates about the rollers 91 as the top flight of the belt is engaged and moved by the user as the user strides thereon. The rheological fluid brake 50'''' is operatively coupled to the front rotating roller 91 in the illustrated embodiment by a drive belt 57'''' and a drive wheel 56''''. Other components of the treadmill 90, similar to those described above, are indicated by quadruple prime notation.

A method aspect according to the present invention is for providing a user selected resistance during exercise on an exercise apparatus of a type including a frame and user actuation means connected to the frame for being engaged and moved by a user during exercise. The method preferably includes the steps of: coupling a rheological fluid brake to the user actuation means, the rheological fluid brake comprising a rheological fluid having a controllable viscosity; and applying a predetermined field strength to the rheological fluid based upon a user selected resistance value to thereby provide the desired resistance.

As described above, in one embodiment, the rheological fluid is a magnetorheological fluid having a controllable viscosity responsive to an applied magnetic field. Accordingly, the step of applying a predetermined field strength comprises applying a magnetic field of predetermined strength to the magnetorheological fluid. In another embodiment, the rheological fluid is a electrorheological fluid having a controllable viscosity responsive to an applied electric field, and wherein the step of applying a predetermined field strength includes applying an electric field of predetermined strength to the electrorheological fluid.

Many modifications and other embodiments of the invention will come to the mind of one skilled in the art having the benefit of the teachings presented in the foregoing descriptions and the associated drawings. For example, the rheological fluid brake may be coupled to other types of user actuation means to provide aerobic training, such as a rowing machine or ski trainer. The rheological brake may have application in strength training, although those of skill in the art will recognize that negative resistance strength training may not be possible using the rheological fluid brake.

As would also be readily understood by those skilled in the art, in other embodiments of the invention, fluid resistance means may be provided by a brake including a viscous fluid contained within a housing, and having a rotatable shaft wherein the fluid has a fixed viscosity or is a rheological fluid operated under a constant field strength. Therefore, it is to be understood that the invention is not to be limited to the specific embodiments disclosed, and that modifications and embodiments are intended to be included within the scope of the appended claims.

That which is claimed is:

1. A method for providing a user selected resistance during exercise on an exercise apparatus of a type including a frame, and user actuation means connected and moveable relative to the frame for being engaged and moved by at least one limb of a user during exercise, wherein the user actuation means includes receiving means receiving the limb of a user and providing an interface for engaging the apparatus, said method comprising the steps of:

engaging a limb of the user with the respective receiving means;

coupling a theological fluid brake to the user actuation means, the rheological fluid brake comprising a rheological fluid having a controllable viscosity; and applying a predetermined field strength to the rheological fluid based upon a user selected resistance value to thereby provide a desired resistance to movement of the user actuation means and receiving by the user.

2. A method according to claim 1 wherein the rheological fluid is a magnetorheological fluid having a controllable viscosity responsive to an applied magnetic field, and wherein the step of applying a predetermined field strength comprises applying a magnetic field of predetermined strength to the magnetorheological fluid.

3. A method according to claim 1 wherein the rheological fluid is a electrorheological fluid having a controllable viscosity responsive to an applied electric field, and wherein the step of applying a predetermined field strength comprises applying an electric field of predetermined strength to the electrorheological fluid.

4. A method for providing a user selected resistance during exercise on an stepper machine of a type including a frame and a pair of foot platforms connected and moveable relative to the frame for being engaged and moved by a user during exercise, said method comprising the steps of:

coupling a rheological fluid brake to the foot platforms, the rheological fluid brake comprising a rheological fluid having a controllable viscosity; and applying a predetermined field strength to the rheological fluid based upon a user selected resistance value to thereby provide a desired resistance to movement of the foot platforms by the user.

5. A method according to claim 4 wherein the rheological fluid is a magnetorheological fluid having a controllable viscosity responsive to an applied magnetic field, and wherein the step of applying a predetermined field strength comprises applying a magnetic field of predetermined strength to the magnetorheological fluid.

6. A method according to claim 4 wherein the rheological fluid is a electrorheological fluid having a controllable viscosity responsive to an applied electric field, and wherein the step of applying a predetermined field strength comprises applying an electric field of predetermined strength to the electrorheological fluid.

7. A method for providing a user selected resistance during exercise on a bicycle of a type including a frame and pedals connected and moveable relative to the frame for being engaged and moved by a user during exercise, said method comprising the steps of:

coupling a rheological fluid brake to the pedals, the rheological fluid brake comprising a rheological fluid having a controllable viscosity; and applying a predetermined field strength to the rheological fluid based upon a user selected resistance value to thereby provide a desired resistance to movement of the pedals by the user.

8. A method according to claim 7 wherein the rheological fluid is a magnetorheological fluid having a controllable viscosity responsive to an applied magnetic field, and wherein the step of applying a predetermined field strength comprises applying a magnetic field of predetermined strength to the magnetorheological fluid.

9. A method according to claim 7 wherein the rheological fluid is a electrorheological fluid having a controllable viscosity responsive to an applied electric field, and wherein the step of applying a predetermined field strength comprises applying an electric field of predetermined strength to the electrorheological fluid.

10. A method for providing a user selected resistance during exercise on a treadmill of a type including a frame and an endless belt connected and moveable relative to the frame for being engaged and moved by a user during exercise, said method comprising the steps of:

coupling a rheological fluid brake to the endless belt, the rheological fluid brake comprising a rheological fluid having a controllable viscosity; and applying a predetermined field strength to the rheological fluid based upon a user selected resistance value to thereby provide a desired resistance to movement of the endless belt by the user.

11. A method according to claim 10 wherein the rheological fluid is a magnetorheological fluid having a controllable viscosity responsive to an applied magnetic field, and wherein the step of applying a predetermined field strength comprises applying a magnetic field of predetermined strength to the magnetorheological fluid.

12. A method according to claim 10 wherein the rheological fluid is a electrorheological fluid having a controllable viscosity responsive to an applied electric field, and wherein the step of applying a predetermined field strength comprises applying an electric field of predetermined strength to the electrorheological fluid.

* * * * *

UNITED STATES PATENT AND TRADEMARK OFFICE

CERTIFICATE OF CORRECTION

PATENT NO. : 5,749,807

DATED : May 12, 1998

INVENTOR(S) : Gregory M. Webb

It is certified that error appears in the above-identified patent and that said Letters Patent is hereby corrected as shown below:

On the title page, Column 1, U.S. Patent Documents, line 20, delete "Lesk" and insert --Leask-- therefor;

On the title page, Column 2, in the Abstract, line 19, delete "a" and insert --an-- therefor;

Column 1, line 10, delete "U.S. Pat. No. 5,374,277" and substitute --U.S. Pat. No. 5,374,227-- therefor;

Column 9, line 48, after "means" (second occurrence), insert --for--;

Column 9, line 53, delete "theological" and insert --rheological-- therefor;

Column 9, line 59, after "receiving", insert --means--;

Column 9, line 67, delete "a" (first occurrence) and insert --an-- therefor;

UNITED STATES PATENT AND TRADEMARK OFFICE

CERTIFICATE OF CORRECTION

PATENT NO. : 5,749,807

DATED : May 12, 1998

INVENTOR(S) : Gregory M. Webb

It is certified that error appears in the above-identified patent and that said Letters Patent is hereby corrected as shown below:

Column 10, line 24, delete "a" (first occurrence) and insert --an-- therefor;

Column 10, line 49, delete "a" (first occurrence) and insert --an-- therefor; and Column 11, line 6, delete "a" (first occurrence) and insert --an-- therefor.

Signed and Sealed this

Twenty-second Day of September, 1998

*Attest:*

Bruce Lehman

BRUCE LEHMAN

*Attesting Officer*

*Commissioner of Patents and Trademarks*